US005669488A

United States Patent [19]

Burger

[11] Patent Number: 5,669,488

[45] Date of Patent: Sep. 23, 1997

[54] PUSH BUTTON SWITCH WITH STAR WHEEL ARRANGEMENT

[75] Inventor: Stefan Burger, Ernstfeld, Germany

[73] Assignee: Cherry Mikroschalter GmbH, Auerbach, Germany

[21] Appl. No.: 621,828

[22] Filed: Mar. 22, 1996

[30] Foreign Application Priority Data

May 15, 1995 [DE] Germany ..... 195 17 779.7

[51] Int. Cl.[6] ..... H01H 13/58

[52] U.S. Cl. ..... 200/528; 200/6 BB

[58] Field of Search ..... 200/528, 526, 200/523, 510, 6 BB

[56] References Cited

U.S. PATENT DOCUMENTS 2,965,737 12/1960 Lewis et al. ..... 200/528
3,281,565 10/1966 Grady et al. ..... 200/528 X
4,129,764 12/1978 Ohkita et al. ..... 200/526
4,771,141 9/1988 Flumignan et al ..... 200/528

*Primary Examiner*—Renee S. Luebke
*Attorney, Agent, or Firm*—Klaus J. Bach

[57] ABSTRACT

In a push button switch with a star wheel having segments with trip cams and being supported in the push button so as to be rotatable about an axis which is normal to the operating direction of the push button, the star wheel is rotated, when the push button is actuated, by an unlatching structure formed on a rotation latch disposed adjacent the star wheel and engaging a projection on the star wheel. The trip cam wheel has cams which operate contact springs disposed adjacent the star wheel along the path of actuating movement of the star wheel whereby contacts are closed or opened depending on the angular position of the cams. Upon release of the push button, the push button is returned by return elements to its original position while the star wheel slides along the contact springs without operating the contacts.

9 Claims, 5 Drawing Sheets

PUSH BUTTON SWITCH WITH STAR WHEEL ARRANGEMENT

BACKGROUND OF THE INVENTION

The invention relates to a push button switch with a star wheel, particularly, to a push button switch wherein operation of a button initiates a switching process between at least one pair of contact elements.

Prior art push button switches with star wheels utilize various principles such as switching mechanisms wherein a switching cam rides on specifically provided guide curves, for example, a heart-shaped curve, or they use ratchet wheels, indexing wheels, etc.

With these known push button switches, the operating button is locked down, after performing an electrical switching function, at a predetermined level below its normal rest position. As a result, the operating button will not return to its rest position after completion of the switching function. Only after a subsequent unlocking stroke, the return path is unblocked so that the operating button can then return to its original position.

The fact that the push button switch has a locked-down position which differs from its rest position is found to be disturbing in many applications, particularly for aesthetic reasons, but often also for functional reasons.

It is the object of the present invention to provide a push button switch with a locking arrangement wherein an operating button initiates a switching procedure but automatically returns to its original (rest) position without deactivating the switching procedure previously initiated and wherein the switch furthermore is easy to assemble.

SUMMARY OF THE INVENTION

In a push button switch with a star wheel having segments with trip cams and being supported in the push button so as to be rotatable about an axis which is normal to the operating direction of the push button, the star wheel is rotated, when the push button is actuated, by an unlatching structure formed on a rotation latch disposed adjacent the star wheel and engaging a projection on the star wheel. The cams of the star wheel operate contact springs disposed adjacent the star wheel along the path of actuating movement of the star wheel whereby contacts are closed or opened depending on the angular position of the cams. Upon release of the push button, the push button is returned by return elements to its original position while the star wheel slides along the contact springs without operating the contacts.

The advantages and features of the present invention will become more readily apparent from the following description of some embodiments in connection with the drawings.

BRIEF DESCRIPTION OF THE DRAWINGS

FIG. 8 shows a three-way diagram with a hysteresis characteristic which is followed upon actuation of a push button switch according to the invention.

DESCRIPTION OF PREFERRED EMBODIMENTS

Figure 1:
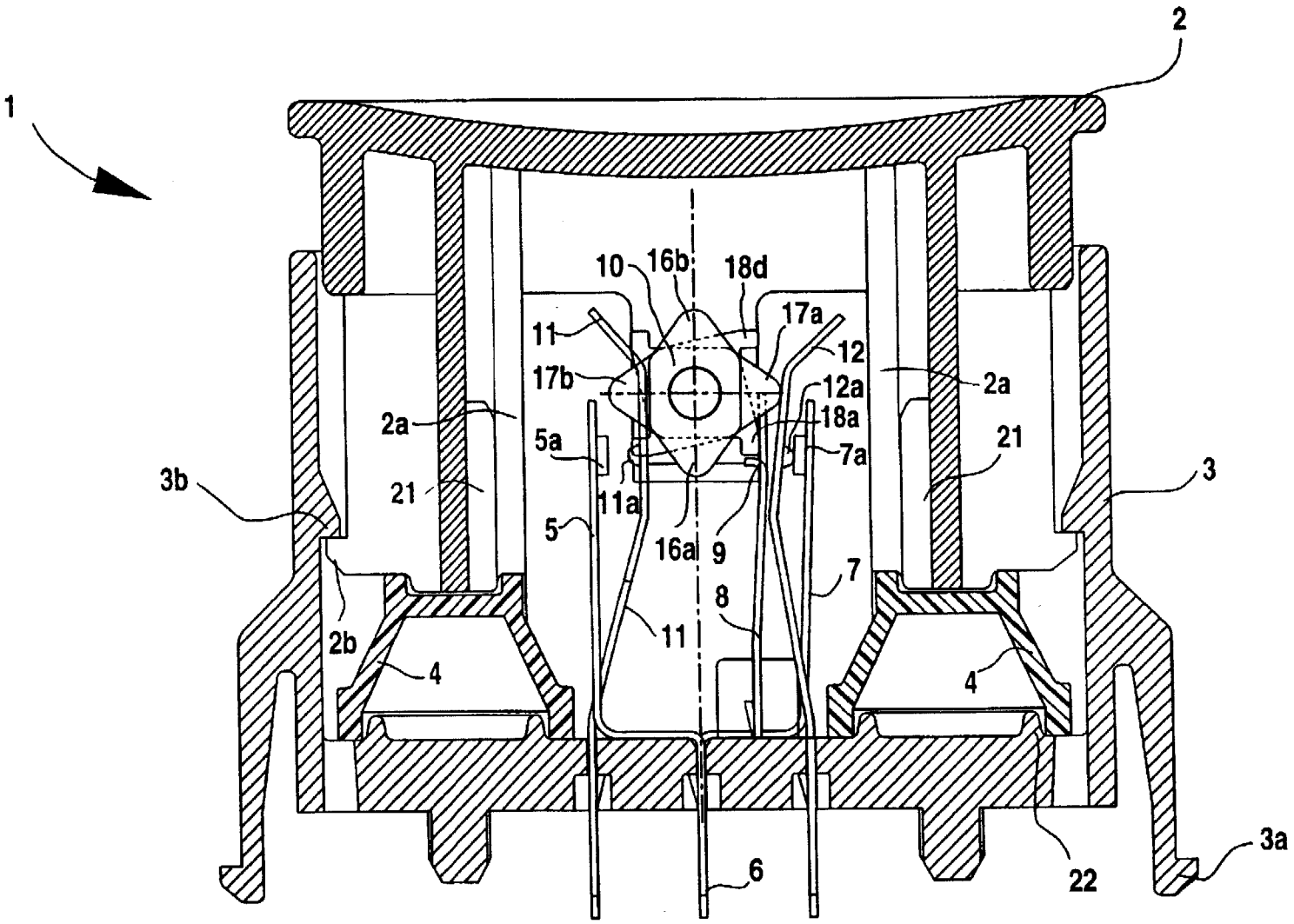
FIG. 1 is a cross-sectional view of the push button switch according to the invention.
Figure 7:
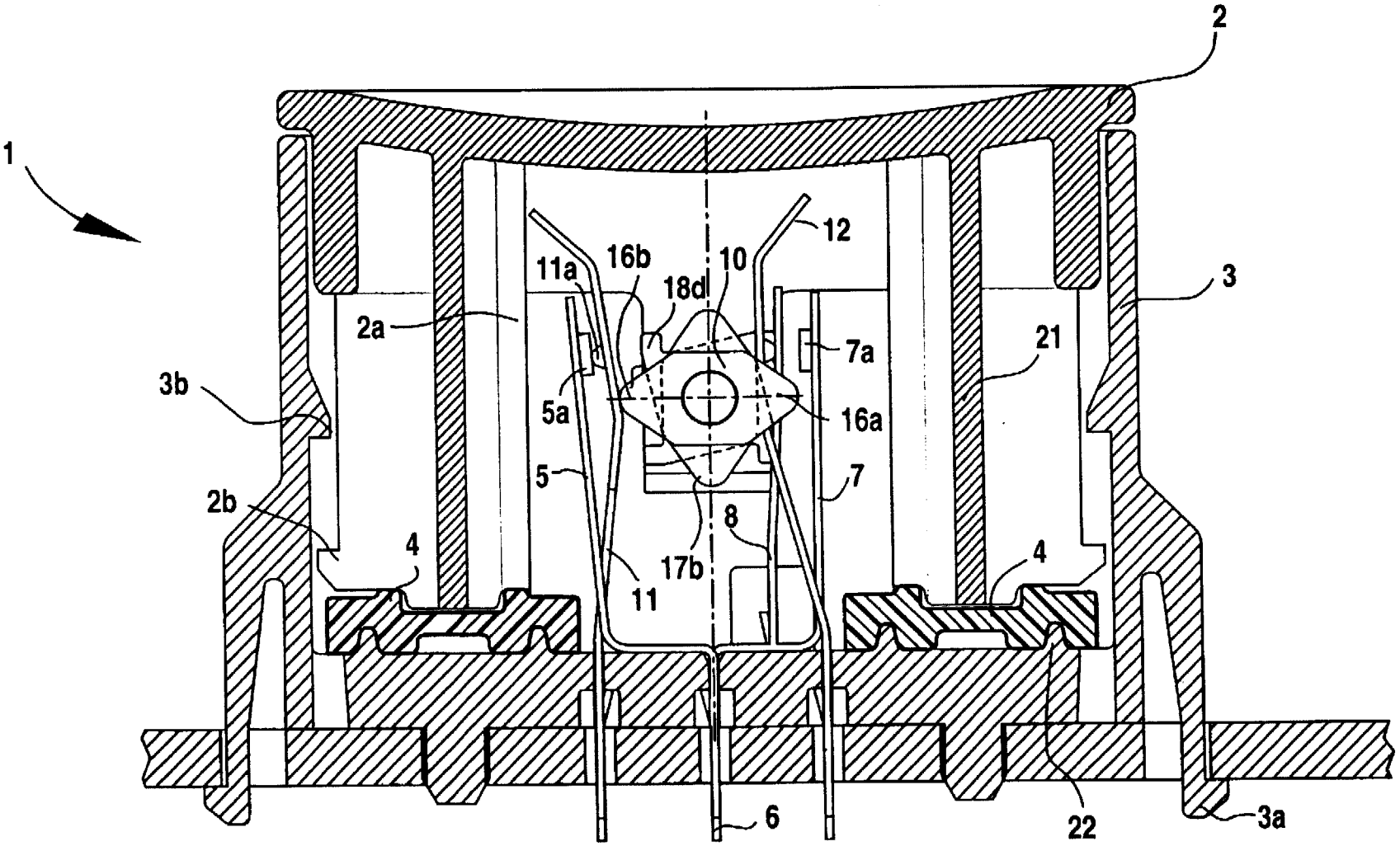
FIG. 7 shows the switch of FIG. 1 in the maximally inserted position.

FIG. 1 is a cross-sectional view of a push button switch 1 according to the invention. It includes a socket 3 having a push button 2 with two guide webs 2*a* extending therefrom and being engaged by two guide walls 21 integrally formed with the socket 3. The side walls 21 project from the socket 3 and have guide surfaces guiding the push button 2 so as to be movable between its top rest position as shown in FIG. 1 and its bottom end position as shown in FIG. 7.

Within the socket, there is at least one pair of contact elements each comprising a contact arm 5 and 7, respectively, having one end firmly mounted and the opposite end freely movable, and associated contact springs 11 and 12, respectively, which have freely movable ends. The contact springs and contact arms have their lower ends embedded in the bottom wall of the socket 3.

As indicated in FIG. 1, the contact arms 5, 7 may be joined in the socket 3 by a common mass connector 6. Electrical contact between the contact spring 11 and a contact arm 5 can be established by moving the contact spring 11 and the contact arms toward one another and it can be broken by moving them away from one another. Current flow can be established or interrupted in this manner.

The push button 2 has enclosed therein a trip cam 10 which is supported so as to be rotatable about an axis X which is normal to the direction of movement of the push button. As shown in connection with FIGS. 2 to 4*c* and as described below in greater detail, the trip cam member 10 includes a number of subsequent cam surface areas with radially outwardly extending cams 16*a*, 16*b*, 17*a*, 17*b* as well as 18*a*–18*d*.

As will be explained in greater detail further below, pushing the push button down causes the trip cam member 10 to rotate whereby the trip cam member 10 engages, with its radial projecting cams 16*a*, 16*b*, 17*a*, 17*b*, the movable ends of the contract springs 11, 12 and moves them into contact with the contact arms 5 and 7, respectively.

Figure 5:
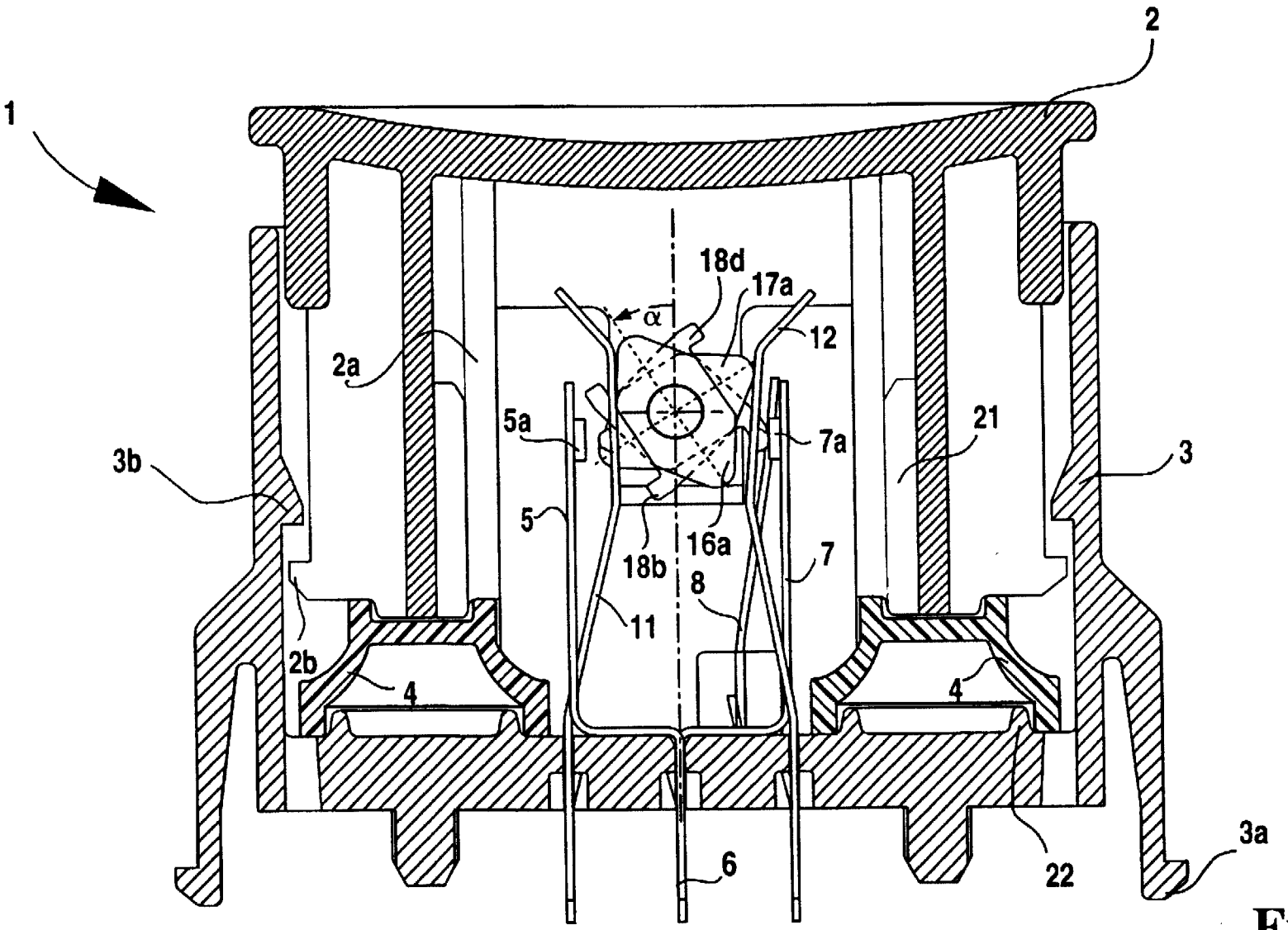
FIG. 5 shows the switch of FIG. 1 in one of the various switching configurations as they occur when the push button is activated between the rest position as represented by FIG. 1.
Figure 6:
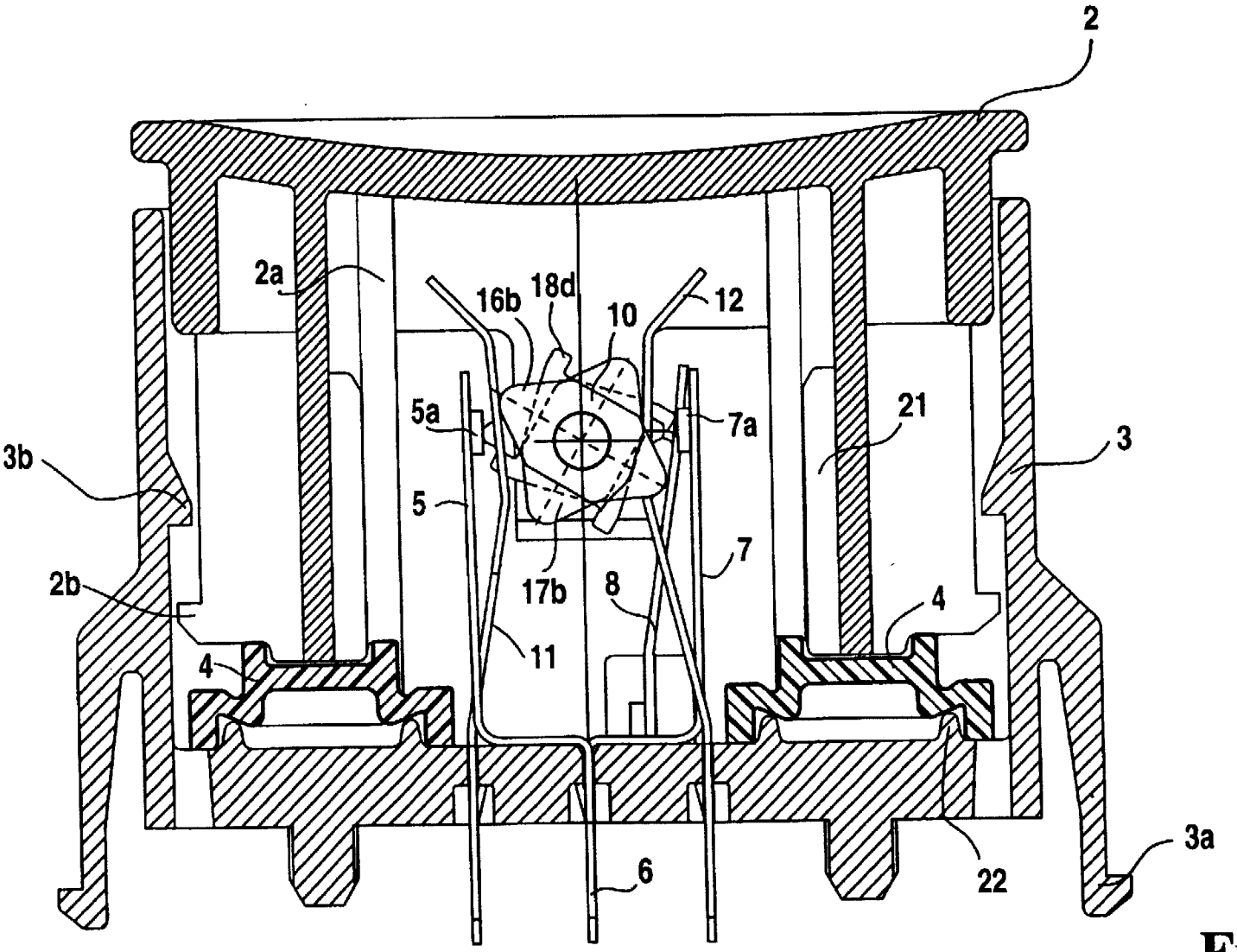
FIG. 6 shows the switch of FIG. 1 in another of the various switching configurations as they occur when the push button is activated between the rest position as represented by FIG. 1.

At the lower ends of the guide walls 21, the push button 2 rests on the return elements 4 which, as shown in FIG. 1 and in FIGS. 5 to 7, may consist of pot-shaped members consisting of a compressible elastic material such as rubber.

The return elements 4 are compressed when the push button is pushed in. This generates within the elastic pot-shaped member a return force which, upon release of the push button, returns the push button to its rest position shown in FIG. 1.

The socket 3 also includes a rotation latch 8 and an unlatching structure 9.

Figure 2:
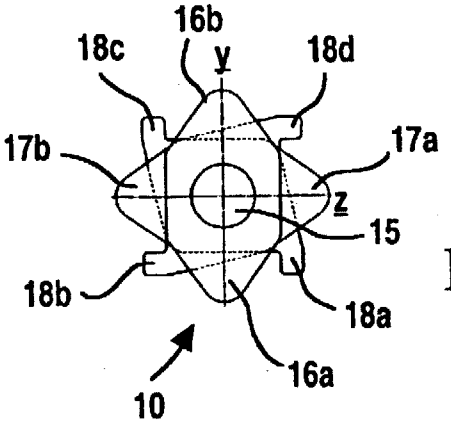
FIG. 2 shows a switching cam as used in the switch of FIG. 1.

FIG. 2 shows the trip cam member 10 of FIG. 1 alone.

Figure 3:
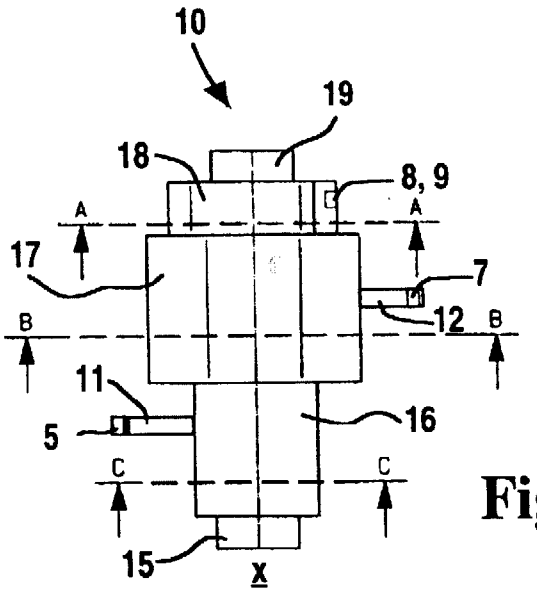
FIG. 3 shows the switching cam of FIG. 2, turned by 90°, including the contact element as well as a rotational latch.
Figure 4A:
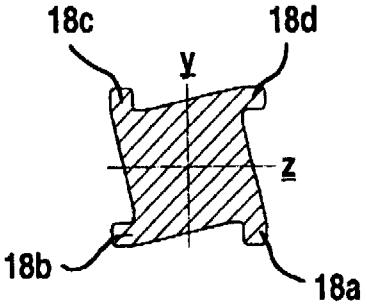
FIG. 4*a* is a cross-sectional view taken along line A—A of FIG. 3.
Figure 4B:
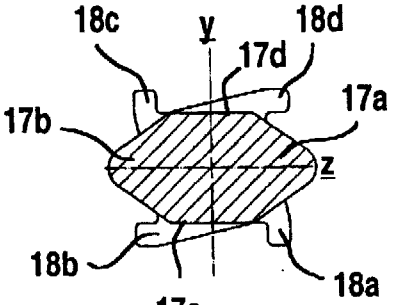
FIG. 4*b* is a cross-sectional view taken along line B—B of FIG. 3.
Figure 4C:
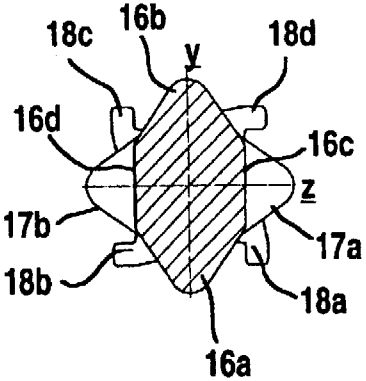
FIG. 4*c* is a cross-sectional view taken along line C—C of FIG. 3.

FIG. 3 shows a preferred embodiment of the trip cam member 10 in a top view in which the trip cam member 10 is turned by 90° with respect to the representation of FIG. 2. This preferred embodiment of a trip cam member 10 as used in a push button switch according to the invention includes a stepped structure and has two bearing journals 15, 19 at its axially opposite ends. The trip cam member 10 is supported in the push button 2 by means of the bearing journals 15, 19 so as to be rotatable therein about an axis X. Between these outer bearing journals 15, 19, there are a number of stepped segments 16, 17, 18. FIGS. 4*a* to 4*c* show the cross-sections of these stepped segments 16, 17 and 18 taken along line A—A for segment 18, line B—B for segment 17 and line C—C for segment 16.

From the section C—C taken across the first segment 16 of the stepped trip cam member 10 as shown in FIG. 4*c*, it can be seen that this first segment includes in the sectional plane C—C first cams 16*a* and 16*b* extending in a first radial direction Y of the trip cam member 10 and, in a direction Z normal to the direction Y, two essentially flat areas 16*c*, 16*d*. The second segment 17 of the stepped trip cam member 10 includes, as shown in FIG. 4*b*, in the sectional plane B—B second radial cams 17*a*, 17*b* extending in the radial direction Z which is normal to the direction Y. In the radial direction Y, the second segment 17 has two opposite essentially flat areas 17*c*, 17*d*.

The third segment 18 of the stepped trip cam member 10 includes drive projections 18*a*, 18*b*, 18*c*, 18*d* which extend radially essentially in the direction of the angle bisector between the first radial direction Y and the second radial direction Z. As shown in FIG. 4*a*, these projections 18*a*–18*d* are displaced angularly around the circumference of the trip cam member 10 by 90° with respect to each other.

It is further apparent from FIG. 3, that the first contact arm 5 and the associated contact spring 11 abut the surface of the trip cam member 10 in the area of the first segment 16. In accordance with the switch position shown in FIG. 1, the first contact arm 5 and the associated contact spring 11 are, in the position of the cam member 10 as indicated in FIG. 3, in an open position in which the freely movable end of the first contact spring 11 is not in contact With the resilient first contact arm 5. Also, in the area of the second segment 17 of the stepped trip cam member 10 at the other end of the axis of rotation X of the trip cam member 10, there is a second contact arm 7 and an associated second movable contact spring 12 which as shown in FIG. 1 are in a closed position.

The trip cam member 10 has further, in the circumferential area of the third segment 18, the rotation latch 8 and the unlatching structure 9 which, in the representation of FIG. 3, are covered by a third projection disposed thereabove and which are indicated therefore only by dashed lines.

The trip cam member 10 and the contact areas 5 and 7 and the contact springs 11 and 12 as well as the rotation latch 8 are so arranged that, upon pushing the push button 2 and thereby moving the associated trip cam member 10 downwardly, the flat areas 16*c*, 16*d*, or respectively, 17*c*, 17*d* on the first as well as on the second segment of the stepped trip cam member 10 move into contact with the freely movable ends of the two contact springs 11 and 12, respectively, so that, because of their internal pretension, they are disengaged from the respective corresponding contact arms 5 and 7, respectively, and can snap back in the direction of the axis X of the trip cam member 10. If, however, the trip cam member 10 is in such a rotational position that the cams 16*a*, 16*b* or respectively, 17*a* 17*b* on the first or the second segment of the stepped trip cam member 10 are in contact with the freely movable ends of the two contact springs 11 and 12, respectively, the contact springs 11, 12 are biased toward the contact arms 5, 7 for electrical contact therewith.

Further, the rotation latch 8 and the unlatching structure 9 are so arranged with respect to the third segment 18 and the radial projections 18*a* to 18*d* thereof that the radial projections 18*a* to 18*d* are engaged by the unlatching structure 9 of the trip cam member 10 when the button 2 is pressed down. The trip cam member 10 and the rotation latch 8 are so arranged relative to one another that, in the rest position of the push button switch, a projection in the area of the third segment is disposed on the unlatching structure 9 projecting from the stationary rotation latch 8.

When the button 2 is pushed downwardly from the rest position as shown in FIG. 5 against the resistance of the return elements 4, the unlatching structure 9 applies a torque to the radial projection (18*a* in FIG. 1) disposed thereon whereby the rotatable trip cam member 10 is rotated counter-clockwise as indicated in FIG. 5 by a rotation angle $\alpha$.

The trip cam member 10 is further so arranged in the push button 2 that, in the rest position as shown in FIG. 1, the cam 17*a* presses the freely moveable end of the contact spring 12 against the second contact arm 7 shown in FIG. 1 at the right, whereby electrical contact is established between the contact area 7 and the contact spring 12. The selection of such a rest position has, at the same time, the result that the freely movable end of the first contact spring 11 comes to lay on the flat area 16*b* of the trip cam member 10 whereby the electrical contact between the first contact spring 11 and the first contact arm 5 is opened as shown in FIG. 1.

Upon pressing of the push button 2, the trip cam member 10 is rotated counter-clockwise as a result of the engagement of a projection of the third segment 18 with the unlatching structure 9 on the rotation latch 8, and the circumferential areas of first segment 16 and of the second segment 17 roll down on the adjacent freely movable ends of the respective contact springs 11 and 12. This movement occurs, with interim positions shown in FIGS. 5 and 6, until the end position of FIG. 7 is reached. At this point, the trip cam member 10 of the push button switch 1 has been turned counterclockwise by 90° from the position shown in FIG. 1.

As a result, the cam 16*b*, shown in FIG. 1 as projecting upwardly, then engages the end of the freely movable contact spring 11 and forces it outwardly in contact with the first contact arm 5. At the same time, in the area of the segment 17, the second cam 17*a* which is shown in FIG. 1 to project to the side, now projects upwardly and the flat area 17*c* is now disposed at the right side adjacent the freely movable end of the second contact spring 12. The contact spring 12 is therefore permitted to disengage the second contact arm 7 whereby the contact between the second contact arm 7 and the second contact spring 12 is opened.

With the switching procedures as indicated in FIGS. 1 and 5 to 7, a double throw switch is provided in which a trip cam member is rotated, over the length of an activation stroke from the rest position as shown in FIG. 1 to the end position as shown in FIG. 7 by 90°. In the process, a contact originally existing between the contact arm 7 and the second contact spring 12 is opened and, between the first contact 11 and the first contact arm 5, contact is established.

When the push button 2 is released, the compressed return elements 4 return the push button 2 to its original position. During this return movement, the trip cam member 10 remains in the position shown in FIG. 7 since the contact springs 11 and 12, respectively, abutting its circumferential areas exert only small frictional forces on the trip cam member 10. Furthermore, the frictional forces exerted by the springs 11 and 12 neutralize one another so that no torque is effective on the trip cam member 10 when it returns with the push button 2 to the rest position thereof. Also, the contact spring 12 which then abuts the flat area 17*c* retains the trip cam member 10 in its position while it slides upwardly along the spring 12.

When the push button 2 returns to its original position as shown in FIG. 1, the trip cam member 10 will not return to the angular position as shown in FIG. 1. Also, the contact springs 11 and 12, respectively, remain in this switching position. Consequently, the push button switch according to the invention provides for a multi-step switch wherein, after each switching step, the operating button returns to its original position.

Obviously, the principle on which the push button switch according to the invention is based, is not limited to the embodiment of a stepped trip cam member 10 as shown in FIG. 3.

By providing a multitude of subsequent stepped segments with cams and essentially flat areas between the cams turned by 90° with respect to one another a trip cam member can be provided by which a multitude of electrical contacts can be switched in a multi-pole push button switch.

Furthermore, instead of having bearing journals 15, 19 at its axial ends, the trip cam member 10 may have bearing structures distributed in axially spaced relationship over the axial length of the trip cam member 10 for supporting the trip cam member 10 in the push button 2. Important is only that rotation of the trip cam member 10 and the stroke length of the push button are so coordinated with one another that the trip cam member 10 is rotated by 90° while the push button is moved from its top to its bottom position.

It is noted that the push button switch as described in connection with FIGS. 1 to 7 is easy to assemble. The socket 3 preferably consists of a plastic material and is injection molded. The contact arms 5, 7 and the contact springs 11, 12 as well as the rotation latch 8 are subsequently mounted into the socket; but they can also be embedded into the socket 3 during the injection molding procedure.

Then the return elements 4 of elastic material are placed over annular projections 22 formed at the bottom of the socket 3. Finally the push button 2 with the trip cam member 10 already mounted therein is inserted into the socket until its snap-in projections 2 are engaged by corresponding locking projection 3*b* on the inside wall of the socket 3.

It is further apparent that the return elements 4 shown in FIGS. 1 and 5 to 7 in the form of domed structures of an elastic material may also be spring elements. However, the return elements 4 of an elastic material such as rubber in the shape of dome structures provide for a particular operating characteristic of the push button switch which will be described in connection with FIG. 8.

FIG. 8 shows the characteristic operating curve for a push button switch 1 which utilizes return elements 4 in the form of elastic domed structures. In a travel length—force diagram as shown in FIG. 9, a hysteresis curve is shown for the push button which has a very desirable configuration. Beginning a point A on the force axis, the upper hysteresis loop first follows a section rising linearly to a second point B.

In the section between point B and a third point C, there is a convexly curved section with a maximum. Between the third point C and fourth point D, the hysteresis curve has a linearly downwardly extending section. The section between the fourth point D and a fifth point E is concavely curved and includes a relative minimum. From the fifth point E to a sixth point F, there is again an upwardly extending section. The sixth point F is the reversal point of the hysteresis curve from where it switches over to the return loop.

Between the return point F and a seventh point G, there is a declining section.

Between the seventh point G and an eighth point H, there is a concavely curved section with a relative minimum.

Between the eighth point H and a ninth point I, the hysteresis curve has a convexly curved section with a relative maximum.

Finally, the curve returns to the force axis along a section which extends essentially linearly between the ninth point I and the tenth point J.

The characteristic hysteresis curve as shown in FIG. 8 is obtained with return elements 4 which are dome shaped and preferably consist of rubber. If normal springs are used as return elements which have linear travel length—force characteristics, the operating characteristic obtained therewith is represented essentially by two straight lines which are inclined at somewhat different angles and which intersect at the return point. (Because of the unavoidable friction, the lower return loop is always somewhat lower than the upper advance loop.)

The first and second contact arms 5 and 7, respectively, and the first and second contact springs 11 and 12, respectively, preferably include raised contact structures 5*a*, 7*a*, 11*a*, 12*a*; as shown in FIGS. 1 and 5 to 7. The contact structure 5*a*, 7*a*, 11*a*, 12*a* of associated contact arms and contact springs are preferably so arranged that, as a result of the rotation of the trip cam member during downward movement of the push button, they are slightly moved relative to one another under friction. With such frictional relative movement, the surfaces of the contact structures remain polished, that is, they remain free of contamination and in a good electrically conductive condition.

What is claimed is:

1. A push button switch comprising: a socket having a base and side walls, a push button disposed in said socket so as to be movable in a linear direction between a normal outwardly extending rest position and inward end position, at least one pair of contact elements each comprising a contact arm and a contact spring projecting from the base of said socket and being actuable by said push button for engagement with one another, a trip cam member having at least two bearing structures by which it is supported in said push button so as to be rotatable about an axis which extends normal to the direction of movement of said push button into, and out of, said socket, said trip cam member comprising at least a first segment having opposite first cams extending in a first radial direction with respect to said axis, and having flattened surface areas on opposite sides of said first cams in planes which are spaced from said axis and extend parallel to said first radial direction, said first contact spring being disposed adjacent said first segment such that said first contact spring is forced into engagement with an associated contact arm when said first contact spring is flexed outwardly by a respective first cam and into contact with said contact arm to establish contact therebetween and that said contact spring is permitted to flex back from said contact arm into abutment with said flat area when said flat area is disposed adjacent said contact spring, and at least another segment having ratchet projections extending radially in a plane including the axis of said trip cam member and extending essentially centrally between an axial plane through the radial projections and an axial plane normal thereto and to said flattened surfaces, at least one stationary rotation latch mounted in said socket so as to be adjacent said trip cam member and having an unlatching structure adapted to catch said ratchet projections for rotating said trip cam member when said push button is actuated, said trip cam member being dimensioned and arranged such that, upon movement of said push button to said end position, said trip cam member is rotated essentially by 90° whereby contact between the contact spring and the contact arm is either established or interrupted, and resilient means disposed in said socket so as to be compressed by said push button when it is actuated for returning said push buttons to said original rest position.

2. A push button switch according to claim 1, wherein said trip cam member has opposite axial ends and bearing journals extending from its opposite axial ends for rotatably supporting said trip cam member in said push button.

3. A push button switch according to claim 1, wherein said resilient means for returning said push button are spring elements.

4. A push button switch according to claim 1, wherein said resilient means for returning said push button are dome-shaped and consist of an elastically deformable material.

5. A push button switch according to claim 4, wherein said dome-shaped means for returning said push button have an operating characteristic which defines, in a travel length—force diagram, a continuous hysteresis curve with an upper loop starting from a first point on the force axis and extending linearly to a second point, then in a convex curve with a maximum to a third point and extending downwardly linearly between the third point to a fourth point, then along a concave curved section with a relative minimum to a fifth point and from there linearly upwardly to a return (sixth) point, from where the the curve extends linearly downwardly back toward the force axis to a seventh point and then along a concave curve with a relative minimum to an eighth and along a convex curve to a ninth point, and, from the ninth point, the curve falls linearly down toward the force axis to a tenth point below the first point by a value corresponding to the friction forces acting on the push button.

6. A push button switch according to claim 1, wherein said trip cam member includes at least a second segment having opposite second cams extending in a second radial direction with respect to said axis which is normal to said first radial direction and flattened surface areas on opposite sides of said second projections in planes which are spaced from said axis and extend parallel to said second radial direction, a second contact spring disposed adjacent said second segment such that said second contact spring is forced into engagement with an associated contact arm when said second contact spring is flexed outwardly by a respective second cam and into contact with said contact arm and that said second contact spring is permitted to flex back into abutment with said flat area when said flat area is disposed adjacent said contact spring.

7. A push button switch according to claim 6, wherein said contact arms are integral members and have a common mass connection disposed in the socket of said push button switch.

8. A push button switch according to claim 6, wherein sad contact arms and also said contact springs have protruding contacts adapted to move slightly relative to one another when they are actuated by said trip cam member.

9. A push button switch according to claim 6, wherein said contact springs have, adjacent said trip cam member, portions which extend essentially parallel to the direction of movement of said push button to facilitate sliding of said trip cam member along said contact springs.

* * * * *